US005228792A

United States Patent [19]

Crevecoeur et al.

[11] Patent Number: 5,228,792

[45] Date of Patent: Jul. 20, 1993

[54] PRINTING DEVICE

[75] Inventors: Martin Crevecoeur, Kreuztal-Ferndorf; Hartmut Edelmann, Siegen; Helmut M. Eicher, Wenden, all of Fed. Rep. of Germany

[73] Assignee: U.S. Philips Corp., New York, N.Y.

[21] Appl. No.: 587,873

[22] Filed: Sep. 24, 1990

[30] Foreign Application Priority Data

Sep. 27, 1989 [DE] Fed. Rep. of Germany ..... 3932177

[51] Int. Cl.[5] ..... B41J 13/26

[52] U.S. Cl. ..... 400/630; 400/708; 271/265

[58] Field of Search ..... 400/703, 707.1, 708, 400/636, 579, 630, 632; 271/265, 272, 273, 274

[56] References Cited

U.S. PATENT DOCUMENTS

| | | | |
|---|---|---|---|
| 3,734,011 | 5/1973 | Williams | 101/91 |
| 3,949,856 | 4/1976 | Ulber et al. | 197/133 R |
| 4,548,394 | 10/1985 | Koyama et al. | 271/265 X |
| 4,892,426 | 1/1990 | Steele | 400/708 |
| 4,978,973 | 12/1990 | Ogushi et al. | 400/708 |
| 4,979,730 | 12/1990 | Holbrook et al. | 271/265 |
| 5,035,413 | 7/1991 | Yamada et al. | 271/265 X |

FOREIGN PATENT DOCUMENTS

| | | | |
|---|---|---|---|
| 2146451 | 3/1972 | Fed. Rep. of Germany . | |
| 0018371 | 1/1985 | Japan | 400/708 |
| 0077769 | 4/1988 | Japan | 400/708 |
| 0027973 | 1/1989 | Japan | 400/708 |
| 0034764 | 2/1989 | Japan | 400/708 |

OTHER PUBLICATIONS

IBM Technical Disclosure Bulletin, vol. 20, No. 11A, Apr., 1978, pp. 4266–4269.

E. T. Brown et al., "Side-Of-Forms, End-Of-Forms, and Forms Jam-Detection Scheme For Printers", IBM Technical Disclosure Bulletin, vol. 20, No. 11 A, Apr. 1978, pp. 4266–4269.

*Primary Examiner*—Edgar S. Burr
*Assistant Examiner*—Christopher A. Bennett
*Attorney, Agent, or Firm*—Ernestine C. Bartlett

[57] ABSTRACT

Paper feed rollers are in a paper supply path before a printing unit. A paper detector is between the printing unit and the paper feed rollers for sensing the presence of paper in the path. A control of the paper transport is facilitated in the paper supply direction by a movement detector before the paper feed rollers, which is driven by the transported paper and produces a number of pulses proportional to the passage length of the paper. The paper detector comprises a magnet on a rotatable lever and a fixed unipolar Hall element. The movement detector comprises a rotatable wheel having multipole magnets on its periphery and a bipolar Hall element secured to respond to the rotating magnetic poles of the wheel.

25 Claims, 2 Drawing Sheets

PRINTING DEVICE

BACKGROUND OF THE INVENTION

1. Field of the Invention

The invention relates to a printing device comprising a printing unit and paper feed rollers arranged in the paper supply direction before the printing unit as well as a paper detector arranged between the printing unit and the paper feed rollers and sensing there the presence of paper.

2. Description of the Prior Art

Such a device is known from DE OS 2146451 which corresponds to U.S. Pat. No. 3,734,011. For controlling the feeding of document cards several detectors are provided therein at different areas of the transport path, which indicate the presence of the document card at these areas or the passage of an edge.

Printing devices can be designed for printing separate sheets or endless paper. Separate sheets can be supplied manually or automatically from a supply stack by means of a separation device. Endless paper is mostly supplied from a folded stack by means of a tractor to the printing device. The paper must be supplied in the correct position to the paper feed rollers of the printing device. The steps of transferring and passing on the paper by the paper feed rollers must be timed with respect to the printing unit in order that the paper can be printed at the desired areas. Especially if several paper transport paths of the kind described are assigned to a printing device, in known solutions numerous paper detectors are required, which should control more particularly the following functions:

- the advance feed path of the paper to the first printing line,
- the transport path of separate sheets to the stacker,
- the transport path of endless paper to the perforated tearing edge,
- the return path of endless paper to a parking position, the start of the automatic paper feeding with manual supply of separate sheets.
- the indication that endless paper has left,
- the monitoring of the paper transport,
- the recognition of the presence or absence of paper,
- the recognition of a jamming of paper, more particularly with endless paper,
- the stopping of printing when the back edge of the paper enters prematurely (for example with too short a form length),
- measurement of the paper length.

SUMMARY OF THE INVENTION

An object of the invention is to construct a printing device of the kind mentioned in the opening paragraph in such a manner that the desired control functions are rendered possible with little effort.

This object is achieved in that in the paper supply direction before the paper feed rollers a movement detector is arranged, which can be driven by the transported paper and produces a number of pulses proportional to the passage length of the paper.

The combination according to the invention of a detector indicating the presence of paper and of a movement detector continuously producing pulses with transported paper as well as the arrangement according to the invention of these detectors on either side of the feed rollers permit a reliable and multilateral control of the paper feeding with all the paper feeder types mentioned.

In case a printing device is designed for several paper supply paths that can alternately be operated, the detectors provided in accordance with the invention are arranged at an area at which all paper supply paths are combined to a common path section. For the different paper supply devices, no separately assigned detectors are then required, but the orderly paper movement can be controlled on all paths in a reliable manner by means of the combination of only one, paper detector and one movement detector.

Preferably the movement detector has a magnet wheel rotatably journalled with respect to a magnetic field sensor and is urged by resilient force on the paper to be transported in such a manner that the magnet wheel periphery frictionally engages the paper by its periphery.

An embodiment with a magnetic field sensor can be constructed in a simple manner and it is less sensitive to disturbances and contaminations than an optically operating sensor.

A narrow and distinct pulse sequence is attained in that the magnetic field sensor is a bipolar Hall element. A simple constructive solution is characterized in that the movement detector is a lever, which carries at one end the magnet wheel and at a fixed distance therefrom the Hall element and is rotatably journalled at the other end.

A solution particularly simple with regard to construction and mounting is obtained in that the movement detector and the paper detector are combined in a common housing block.

The spatial distance between the sensing areas of the paper detector and of the movement detector can advantageously be attained in that the paper detector has a sensing lever, whose lever arm comprising the paper sensing area projects from the housing block substantially in the forward transport direction of the paper.

A control device, which is usually assigned to a printing device and which controls the driving motors for the different paper transport devices, is designed, in order to fully utilize the detectors proposed in accordance with the invention, advantageously in such a manner that the signal of the paper detector permits the recognition of the front edge and/or of the back edge of the paper and hence also of the paper length and its presence and a synchronization of the paper advance feed, and that the signal of the movement detector permits a recognition of the start of its movement and through pulse counting the determination of the transport length of the paper then attained until the front edge of the paper is recognized at the paper detector and synchronized with the position counting of the vertical drive.

IN THE DRAWING

In order that the invention may be readily carried out, it will now be described more fully, by way of example, with reference to the accompanying drawing, in which:

FIG. 1 shows diagrammatically the assignment of the essential elements of a printing device according to the invention having several paper transport paths, FIG. 2 shows a combined detector, which is composed of a paper detector and a movement detector, and FIG. 3 is an exploded view of the combined detector shown in FIG. 2.

DESCRIPTION OF THE PREFERRED EMBODIMENT

Figure 1:
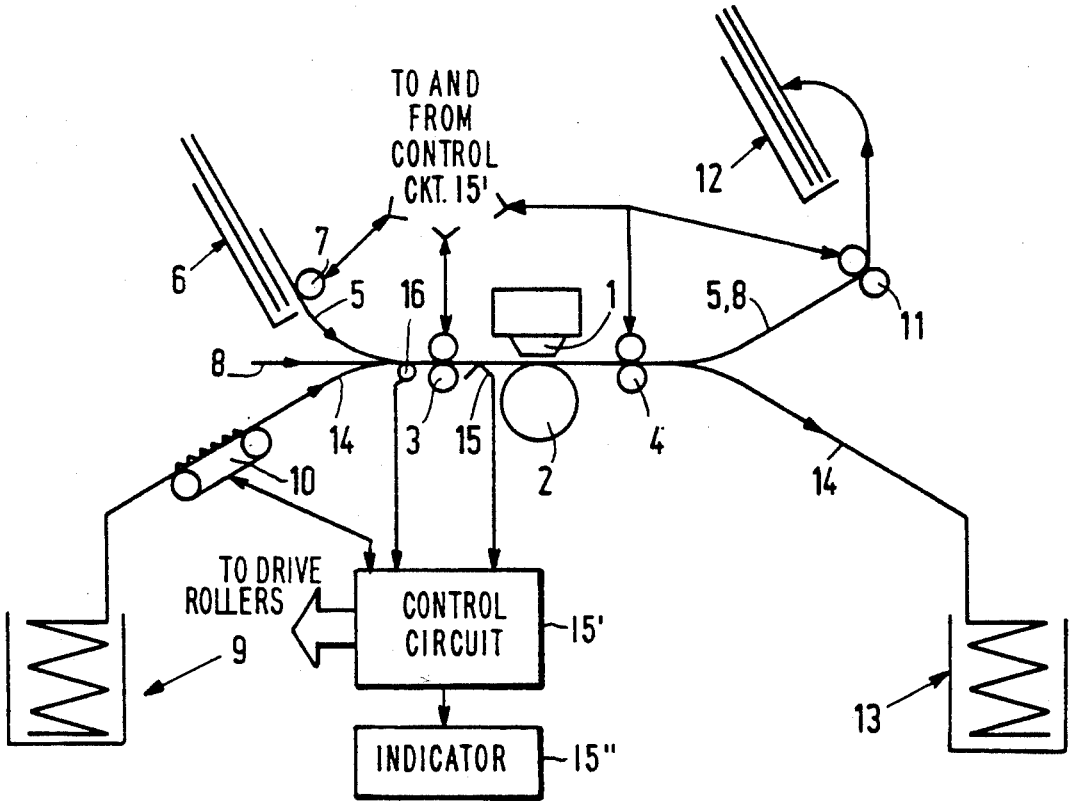

In FIG. 1, paper to be printed is passed between the printing unit 1 (for example a needle printing head) and the printing roller 2. The paper is first transported by the paper feed rollers 3 and then by the paper transport rollers 4. Separate sheets can be transported through the path 5 from a cassette 6 by means of separation roller 7 to rollers 3. After having been printed, the separate sheets are passed through transport rollers 4 and 11 into a stacker 12.

Through the path 8, separate sheets can be passed manually to the paper feed rollers 3. From the container 9, folded endless paper can be passed by means of the tractor 10 along the path 14 to the paper feed rollers 3. The endless paper is filed, after having been printed, in a stacker 13 in a folded state. At the area of the paper feed rollers 3, at which all paper supply paths are combined to a common path section, a paper detector 15 and a movement detector 16 are arranged. The paper detector 15 produces two different output levels, in dependence upon whether paper is present or not present at its sensing area. A level variation is obtained when a paper edge enters or leaves.

The movement detector 16 produces upon activation by passing paper a number of pulses proportional to the paper transport length. Without paper movement, the output level of the movement detector is constant. The movement detector 16 therefore senses the movement of the paper (pulses are present). It can further detect the instant at which paper enters at its sensing area (by way of the first pulse generated). By counting the pulses via control circuit 15', the paper length transported from the sensing area can also be determined by circuit 15'.

When separate sheets are manually supplied, the movement detector recognizes incoming paper by producing a first pulse. The paper path to the paper feed rollers 3 is monitored by circuit 15' by counting a given number of pulses generated by the movement detector 16. After a given waiting time, during which the paper is aligned with respect to the still stationary paper feed rollers 3, automatic further transport is taken over by the paper feed rollers 3. The paper detector 15 output signal is sensed by circuit 15' and recognizes the front edge of the paper and hence synchronizes the counting for a stepwise paper advance feed. When the paper detector 15 is not operated, for example, when the paper is not gripped by the paper feed rollers 3 or is retracted by the operator, a paper transfer error is indicated by circuit 15' via indicator 15''.

When paper is automatically fed from the cassette 6, first it is ascertained by means of the paper detector 15 and circuit 15' whether paper is still present in the printing device. If paper is present, the ejection routine is started until the paper end is sensed by the paper detector 15. Subsequently, the paper separation and the automatic feeding of further sheets from the cassette 6 are actuated by circuit 15' driving the corresponding rollers. The movement detector 16 senses the incoming paper by providing a pulse. Circuit 15' in response to this sensed pulse stops the paper feed rollers 3 in order that an alignment of the paper is possible. For this purpose, the paper path is monitored by the movement detector 16 and circuit 15' by counting the corresponding number of pulses produced by detector 16. After the alignment of the paper, the paper feed rollers 3 take over the further transport of the paper, whose front edge is recognized by the paper detector 15 whose output signal is processed by circuit 15', as a result of which the counting for the stepwise paper transport is synchronized by circuit 15' and a separation drive roller 7 for the paper supply is switched off.

If, for example, in the case of graph printing a backward transport in a direction opposite the direction of the arrow on path 8 of separate sheets from the cassette 6 is required, the paper just printed is returned into the path 8 for manual feeding. For this purpose, the paper is transported forwards toward unit 1 until the movement detector 16 comes to a standstill and hence produces no more pulses. Control 15' then releases the backward transport by releasing rollers 3. This recognition of the paper end by detector 16 even before the signal of the paper detector 15 is generated ensures that the paper is fed over such a distance that it can be deflected to the paper path 8 without the paper end portion having to leave the paper feed rollers 3.

The paper detector 15 can also recognize the paper end by producing a signal at that time. Thus, the length of a separate sheet can be determined by circuit 15' so that regardless the length of a paper sheet it is not printed with too many lines or beyond its length.

When endless paper is fed, the paper detector 15 recognizes the presence or absence of paper by an appropriate output signal. If paper is not present, control 15' senses this condition generating a control signal so that the tractor 10 is started. The tractor 10 transports the paper until the paper detector 15 recognizes its front edge generating a signal manifesting this condition and synchronizes therewith the counting of the pulses produced by detector 16 for the stepwise paper infeed. The movement detector 16 in this case need not be interrogated for purposes of alignment as discussed above because the paper is aligned by the guides in the tractor 10 so that of course the alignment required for separate sheets is not required at the stationary paper feed rollers 3 for endless paper.

The movement detector 16, however, serves to generate a stream of pulses as long as paper moves relative thereto so circuit 15' can monitor the further transport of the endless paper. When the pulse signal from detector 16 fails to arrive, this means that paper is no longer present. In the case of backward transport beyond the limit of one end of the endless paper, the end edge is sensed by the paper detector 15 whose output is fed circuit 15' which ascertains whether the end is present. For this purpose, the paper is moved backwards beyond the paper detector 15. In the case of backward transport of the paper into a parking position, the paper detector 15 produces a signal manifesting the front edge of the paper during the backward movement. The paper is then moved along a given path into the parking position. In this way, circuit 15' can determine whether one end of the endless paper is actually present.

A paper jamming can be detected by circuit 15' by comparison of the output signals of the movement detector 16 with information about the rotational path of the paper transport drives.

Figure 2:
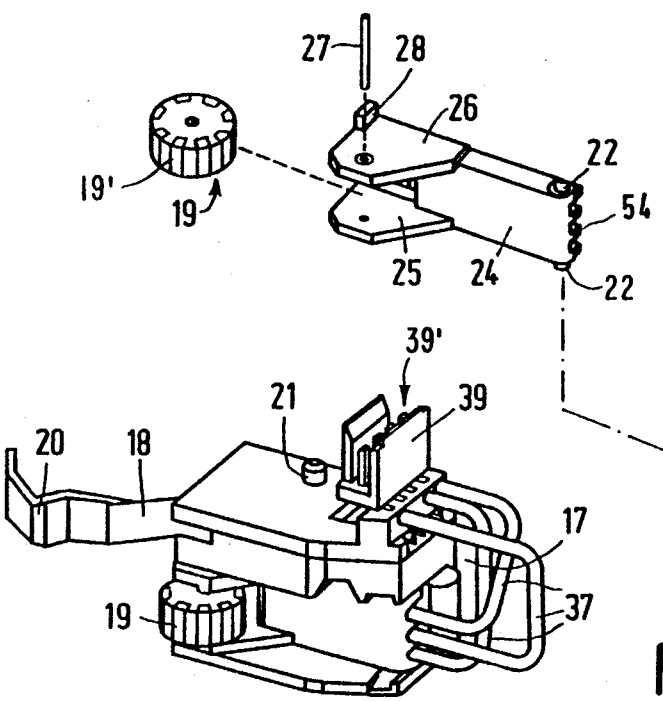

The detectors 15 and 16 are combined according to FIG. 2 into a housing block 17. A sensing lever 18 projects from block 17. Movement detector 16 described with reference to FIG. 1 has a multi-pole radially magnetized magnet wheel 19 rotatably secured to block 17 via lever 24. Wheel 19 has poles 19' about its periphery. The sensing area 20 of the sensing lever 18 is located at such a distance from the magnet wheel 19 that the paper according to FIG. 1 can be sensed at different areas before and behind the paper feed rollers 3. The combined detector can be snapped by means of several snap journals 21 into associated snap openings of the printing device or into snap openings of a mounting member attached to the printing device.

Figure 3:
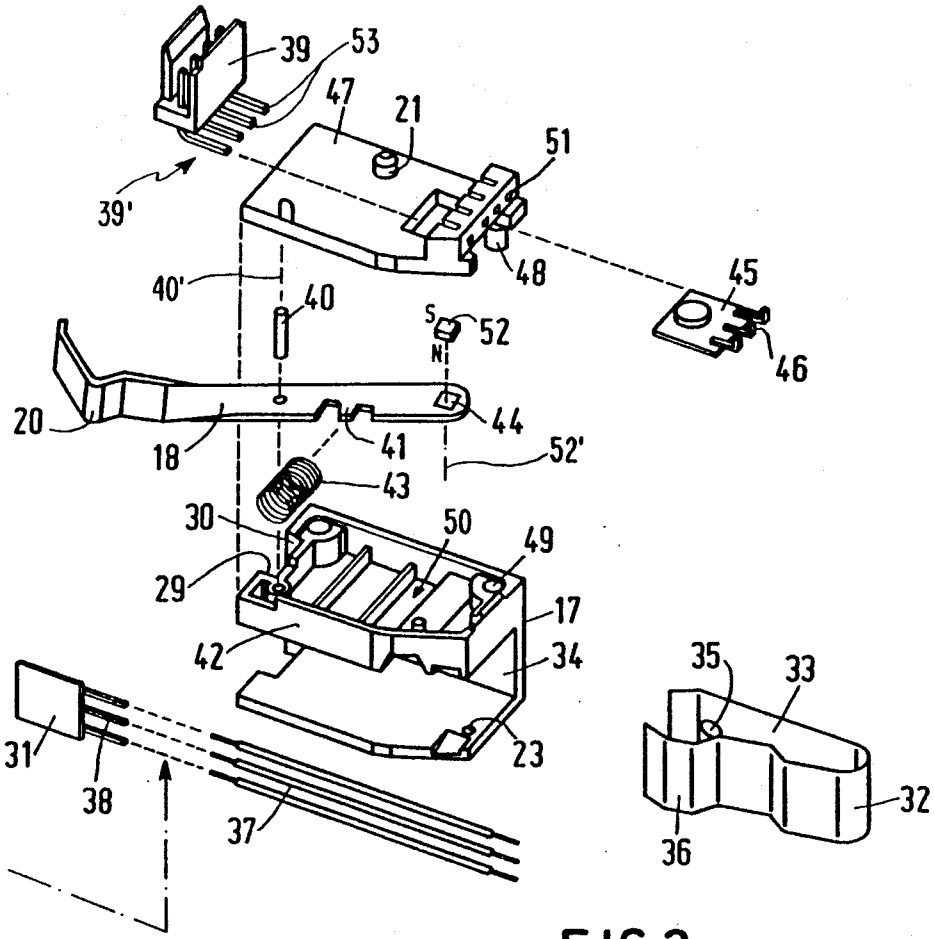

The construction of the combined detector according to FIG. 2 can be seen more precisely in the exploded view of FIG. 3 shown on an enlarged scale. The movement detector 16 comprises an injected molded housing lever 24, which is pivotably journalled by injected molded journals 22 which mate in journal bores 23 of the housing block 17. Lever 24 has bearing walls 25 and 26 between which the magnet wheel 19 is rotatably secured on inserted shaft 27. Abutment projections 28 on lever 24 limit the pivot angle between the edges 29 and 30 of the housing block 17. A bipolar Hall element 31 is engaged by shape and dimensions into a mating receiving space (not shown) on the back side of the lever 24 and is locked therein by bent spring 32. The arm 33 of the spring 32 engages the bottom wall 34 of the housing block 17 and is held in position by a journal (not shown) of the bottom wall 34 engaging into the spring 32 bore 35. The bent spring arm 36 presses the lever 24 outwards so that the magnet wheel roller 19 is pressed resiliently against paper present in the printing device. By means of connection leads 37, the electrical connections 38 of the Hall element 31 are connected to corresponding conductors 39' of connection block 39. The connection points between the connection leads 37 and the connections 38 are locked in ducts 54 of the lever 24 against mutual contact and against contact with the spring arm 36. As the equally spaced magnetic poles of wheel 19 roll past Hall element 31, pulses are produced in a known way on connections 38. When paper moves against the resiliently loaded wheel 19 periphery, the wheel is caused to rotate by friction. Because the wheel 19 has a given diameter, the number of pulses produced is a measure of linear length of the paper rotating the wheel.

A chamber 50 is provided in the housing block 17 for detector 15. The sensing lever 18 is journalled on a stub shaft 40 inserted into the housing block 17 and is prestressed by compression spring 43 in the chamber 50. Spring 43 is between holding nose 41 of lever 18 and wall 42 of block 17. The paper sensing area 20 of lever 18 projects into the paper path from block 17 forward of the transport direction and is pressed by incoming paper against the pressure of the spring 43 rotating lever 18 about journal 40. A permanent magnet 52 is in a recess 44 of the sensing lever 18. Magnet 52 rotates about shaft 40 axis 40' with respect to a unipolar Hall element 45 so that different signal levels are produced at output connections 46 of the element 45 in a known way. The sensing lever 18, the spring 43 and the shaft 40 are held in the chamber 50 by a covering plate 47, whose journals 48 (only one being shown) engage into mating bores 49 of the housing block 17. The Hall element 45 is also held by its shape and dimensions between the covering plate 47 and the housing block 17. The contact terminals 53 of the connection conductors 39' pass through bores 51 of the covering plate 47 and are held in position after having been soldered to the corresponding connection leads 46 of the Hall element 45.

The parts of the combined detector shown in FIGS. 2 and 3 are locked by mutual engagement by shape and dimensions. The whole unit—except for the soldering connections—can be mounted without the use of auxiliary tools. The combined detector constructed in accordance with the invention operates in a reliable manner without the use of complicated adjustment measures. Because of the use of magnetic field sensors, the signals can be evaluated unambiguously even with comparatively wide incorporation tolerances.

In order to increase the resolution during the measurement of the paper path through the movement detector 16, a second bipolar Hall element can be mounted at an angle of Pi/4 to the first bipolar Hall element 31 on the lever 24. By the methods for electrical signal multiplication described in the relevant literature, the resolution can be strongly refined by linkage of the two output signals relatively offset by Pi/4. Further, an additional directional signal is obtained, which indicates the actual direction of movement of the paper. For example, it may be ascertained therefrom whether paper is manually inserted into the printer or is pulled out of the printer.

The signals of the paper detector 15 and of the movement detector 16 are evaluated in a usual manner known to those skilled in the art through electronic control circuits corresponding to circuit 15' and are finally converted in accordance with a desired paper transport path into suitable actuation commands for driving motors (not shown) of the different paper transport drives. The construction of such control circuits is not the subject matter of the present invention and is known essentially from the aforementioned German patent specification DE-OS 2146451 and corresponding U.S. Pat. No. 3,734,011.

What is claimed is:

1. A printing device comprising:

a printing unit;

a paper transport device which comprises a plurality of paper feed rollers in a paper supply path arranged before the printing unit relative to a paper supply direction for transporting paper;

a paper detector arranged between the printing unit and the rollers for sensing and signaling the presence or absence of paper;

a movement detector arranged in the paper supply path, the paper feed rollers being arranged between the movement detector and the printing unit, the movement detector being driven by the transported paper and continuously producing a plurality of pulses proportional to the length of the paper passing the movement detector; and a control device for said paper transport device operatively adapted to recognize signals from said paper detector and said movement detector and to control said transport device responsive thereto;

the arrangement of said detectors with said rollers arranged between them being effective to allow control of the transport and alignment of the paper relative to the printer.

2. A printing device as claimed in claim 1 wherein the printing device has several paper supply paths which merge in a common path section, said paper and movement detectors being located at the area at which said paper supply paths merge.

3. A printing device as claimed in claim 1 further including a housing secured to the support, the movement detector and the paper detector being secured to said housing.

4. A printing device as claimed in claim 1 further including a housing secured to the support, the paper detector including a sensing lever secured to the housing and having a paper sensing area projecting from the housing substantially in the forward transport direction of the paper.

5. A printing device as claimed in claim 1 further including a housing having a journal chamber and secured to the support, wherein the movement detector includes a lever rotatably journalled in the journal chamber of the housing.

6. The device of claim 1 wherein said paper and movement detectors produce output signals respectfully manifesting 1) the sensed presence and absence and 2) movement of said paper in said path, said device including control circuit means responsive to said output signals of said paper and movement detectors for recognizing at least one of the forward and rear edges of paper in said paper path, for determining the length of said paper and for sensing the start of movement of the paper in said path.

7. A printing device comprising:

a support;

a printing unit secured to the support;

a plurality of paper feed rollers rotatably secured to the support in a paper supply path before the printing unit relative to a paper supply direction for transporting paper;

a paper detector secured to the support between the printing unit and the rollers for sensing the presence of paper; and a movement detector secured to the support in the paper supply path, the paper feed rollers being between the movement detector and the printing unit, the movement detector being driven by the transported paper and producing a plurality of pulses proportional to the length of the paper passing said movement detector, wherein the movement detector includes a first magnetic field sensor and a magnet wheel rotatably journalled with respect to said first magnetic field sensor, said movement detector also including means for resiliently urging the magnet wheel against the paper to be transported such that the magnet wheel periphery frictionally engages the paper.

8. The device of claim 7 wherein said paper and movement detectors produce output signals respectfully manifesting 1) the sensed presence and absence and 2) movement of said paper in said path, said device including control circuit means responsive to said output signals of said paper and movement detectors for recognizing at least one of the forward and rear edges of paper in said paper path, for determining the length of said paper and for sensing the start of movement of the paper in said path.

9. A printing device as claimed in claim 7 wherein the magnetic field sensor is a bipolar Hall element.

10. A printing device as claimed in claim 9 wherein the movement detector comprises a lever which rotatably secures at one end the magnet wheel and is rotatably journalled to the support at the other end.

11. The device of claim 10 wherein said paper and movement detectors produce output signals respectfully manifesting 1) the sensed presence and absence and 2) movement of said paper in said path, said device including control circuit means responsive to said output signals of said paper and movement detectors for recognizing at least one of the forward and rear edges of paper in said paper path, for determining the length of said paper and for sensing the start of movement of the paper in said path.

12. A printing device as claimed in claim 10 including a housing secured to the support wherein the movement detector and the paper detector are secured to said housing.

13. A printing device as claimed in claim 12 wherein the paper detector includes a sensing lever having a paper sensing area projecting from the housing substantially in the forward transport direction of the paper.

14. A printing device as claimed in claim 13, wherein the housing comprises a permanent magnet and wherein the sensing lever has opposing ends, at one lever end of the sensing lever of the paper detector is secured the permanent magnet magnetized with its poles lying on an axis parallel to the axis of rotation of the sensing layer, and a second magnetic field sensor secured to the housing opposite said permanent magnet in a fixed position relative to the housing.

15. The device of claim 13 wherein said paper and movement detectors produce output signals respectfully manifesting 1) the sensed presence and absence and 2) movement of said paper in said path, said device including control circuit means responsive to said output signals of said paper and movement detectors for recognizing at least one of the forward and rear edges of paper in said paper path, for determining the length of said paper and for sensing the start of movement of the paper in said path.

16. A printing device as claimed in claim 13 wherein the housing has a first receiving chamber, a covering plate over the receiving chamber, and a shaft held in the receiving chamber by the covering plate, said sensing lever being journalled in said first receiving chamber on the shaft and being held by said covering plate.

17. A printing device as claimed in claim 16 wherein the housing has a journal chamber and said movement detector lever is rotatably journalled in said journal chamber.

18. A printing device as claimed in claim 17 wherein the housing has journal bores and abutment surfaces and the lever of the movement detector includes abutment projections and two journals associated with said journal bores and which journals snap into the associated journal bores, the range of rotation of the lever of the movement detector being limited by the abutment projections on the lever which engage said abutment surfaces of the housing.

19. A printing device as claimed in claim 18 wherein the housing has a second receiving chamber and a spring, said magnetic field sensor being in said second receiving chamber, said movement detector lever being held in said housing by said spring which resiliently urges the wheel against the paper in the paper path.

20. A printing device as claimed in claim 19 wherein the movement detector lever has first and second ends, at one lever end of the sensing lever of the paper detector a permanent magnet magnetized with its poles lying on an axis parallel to the axis of rotation of the sensing lever is included, and a second magnetic field sensor is opposite said permanent magnet in a fixed position relative to the housing.

21. A printing device as claimed in claim 20 wherein the support includes a housing mounting member having snap recesses, the housing including outwardly projecting snapping journals which snap into said snap recesses of the mounting member.

22. The device of claim 21 wherein said paper and movement detectors produce output signals respectfully manifesting 1) the sensed presence and absence and 2) movement of said paper in said path, said device including control circuit means responsive to said output signals of said paper and movement detectors for recognizing at least one of the forward and rear edges of paper in said paper path, for determining the length of said paper and for sensing the start of movement of the paper in said path.

23. A printing device comprising:

a support;

a printing unit secured to the support;

a plurality of paper feed rollers rotatably secured to the support in a paper supply path before the printing unit relative to a paper supply direction for transporting paper; and a paper detector secured to the support between the printing unit and the rollers for sensing the presence of paper; and a movement detector secured to the support in the paper supply path, the paper feed rollers being between the movement detector and the printing unit, the movement detector being driven by the transported paper and producing a plurality of pulses proportional to the length of the paper passing said movement detector, wherein the printing device has several paper supply paths which merge in a common path section, said paper and movement detectors being located at the area at which said paper supply paths merge, and wherein the movement detector includes a first magnetic field sensor and carries a multipole magnet wheel rotatably journalled with respect to said first magnetic field sensor, said movement detector also including means for resiliently urging the magnet wheel against the paper to be transported such that the magnet wheel periphery frictionally engages the paper.

24. A printing device comprising:

a support;

a printing unit secured to the support;

a plurality of paper feed rollers rotatably secured to the support in a paper supply path before the printing unit relative to a paper supply direction for transporting paper;

a paper detector secured to the support between the printing unit and the rollers for sensing the presence of paper;

a movement detector secured to the support in the paper supply path, the paper feed rollers being between the movement detector and the printing unit, the movement detector being driven by the transported paper and producing a plurality of pulses proportional to the length of the paper passing said movement detector, wherein the movement detector comprises a magnet wheel and a sensing lever having first and second ends which lever carries at one end the magnet wheel and is rotatably journalled to the support at the other end.

25. A printing device comprising:

a support;

a housing secured to the support;

a printing unit secured to the support;

a plurality of paper feed rollers rotatably secured to the support in a paper supply path before the printing unit relative to a paper supply direction for transporting paper;

a paper detector secured to the support between the printing unit and the rollers for sensing the presence of paper;

a movement detector secured to the support in the paper supply path, the paper feed rollers being between the movement detector and the printing unit, the movement detector being driven by the transported paper and producing a plurality of pulses proportional to the length of the paper passing said movement detector;

wherein the movement detector comprises a magnetic field sensor and a sensing lever secured to the support, wherein the housing has first and second receiving chambers and a spring, said magnetic field sensor being in said second receiving chamber, and said sensing lever being held in said housing by the spring which resiliently urges the wheel against the paper in the paper path.

* * * * *